United States Patent [19]

Lewis

[11] 4,367,819

[45] Jan. 11, 1983

[54] DISPLAY RACK

[75] Inventor: Lawrence A. Lewis, Englewood, N.J.

[73] Assignee: Clip Strip Corporation, South Hackensack, N.J.

[21] Appl. No.: 173,817

[22] Filed: Jul. 30, 1980

[51] Int. Cl.[3] ..... A47F 5/08

[52] U.S. Cl. ..... 211/59.1; 211/87; 248/205 A; 248/222.2

[58] Field of Search ..... 211/87, 57.1, 59.1, 211/101, 105.1; 248/205 A, 222.2, 222.3, 224.3, 225.1, 225.2

[56] References Cited

U.S. PATENT DOCUMENTS

| | | | |
|---|---|---|---|
| 888,032 | 5/1908 | Peterson | 211/87 X |
| 1,575,270 | 3/1926 | Jankowsky | 248/225.1 X |
| 2,665,869 | 1/1954 | Samuels | 211/87 X |
| 3,252,678 | 5/1966 | Myers et al. | 211/59.1 X |
| 3,279,620 | 10/1966 | Nesbitt | 211/87 |
| 4,037,729 | 7/1977 | Desisto | 211/87 X |

*Primary Examiner*—Roy D. Frazier
*Assistant Examiner*—Robert W. Gibson, Jr.
*Attorney, Agent, or Firm*—Brooks, Haidt, Haffner & Delahunty

[57] ABSTRACT

A display rack comprising a relatively long and narrow support member with a plurality of projections spaced therealong, each projection having a plurality of differently oriented holes for receiving an arm of a hook so that a hook may extend in the same direction regardless of the orientation of the support. The hook may also have a foot which engages the support when the support extends vertically or which engages the supporting surface on which the support is mounted when the support extends horizontally.

9 Claims, 8 Drawing Figures

DISPLAY RACK

This invention relates to a display rack or support device having a supporting strip with a plurality of differently oriented holes for receiving detachable hooks and supporting them in different positions.

Display racks having a supporting member which may be adhesively secured to a wall, a partition, etc. and having one or more hooks or clips secured thereto are well known in the art. See, for example, U.S. Pat. Nos. 3,458,945 and 3,504,878. However, generally speaking, the supporting member can be mounted only with one orientation because the hooks or clips extend in one direction from the member and no simple provision is made for changing such direction. Thus, one rack is used when it is desired to have the hooks or clips aligned vertically, and another rack is used when it is desired to have the hooks or clips aligned horizontally. This is inconvenient not only from the manufacturing standpoint but also from the ordering and inventory standpoints.

Accordingly, it is desirable to provide a single display rack which can be mounted with the hooks aligned either horizontally or vertically. However, it has been found that if the supporting member is elongated and is secured adhesively to a support, the adhesive is adequate to maintain the member secured to the support when the length of the member extends vertically but it is not adequate in many cases, e.g. the articles to be supported are relatively heavy, when length of the same member extends horizontally. This latter problem can be overcome by increasing the width of the supporting member and the width of the adhesive area, but such a solution is not satisfactory because it increases the cost and size of the supporting member.

I have discovered by experimentation that the problem of detachment of the supporting member from a support with relatively heavy loads can be overcome without increasing the width of the supporting member and the adhesive by providing each of the detachable hooks with a foot which extends over a side edge of the supporting member and engages the support when the length of the supporting member extends horizontally. The holes in the supporting member for receiving one end of a hook are sized and disposed so that when the length of the supporting member extends vertically, the foot bears against the face of the supporting member. While such construction of the hooks and the supporting member is intended primarily for racks which are adhesively secured to a support, such construction is also useful when the racks are secured to a support by other means which cannot withstand the load placed on the supporting member when its length extends horizontally.

It is one object of the invention to provide a simple and relatively inexpensive display rack with a supporting member having means for receiving detachable hooks, which supporting member can be differently oriented on a support with the hooks aligned either in a first direction or in a second direction transverse to the first direction.

It is a further object of the invention to provide a simple and relatively inexpensive display rack which comprises an elongated supporting member having means for receiving hooks, which can be mounted with the length of the supporting member extending either vertically or horizontally with the hooks respectively aligned vertically or horizontally and which has improved resistance to detachment from a support when the length of the supporting member extends horizontally.

In accordance with the preferred embodiment of the invention, the display rack comprises a relatively long and narrow supporting member which may, for example, be molded from a plastics material. At its back face, that is, the face thereof which faces a support to which it is to be attached, there is a layer of resilient or sponge-like material which is adhesively secured to such face. The face of the sponge-like layer opposite to the one which engages the support member has an adhesive thereon, preferably of the contact type, which is covered by a conventional peelable strip. The front face of the supporting member has a plurality of multi-lateral projections with openings in the walls thereof for receiving hooks. The hooks have a free end for receiving articles to be displayed and have an opposite end of a special configuration, part of which is inserted in one of said openings and part of which, a foot, either extends over a side of the supporting member for engaging the support to which the supporting member is adhesively secured or engages the front face of the supporting member.

Other objects and advantages of the present invention will be apparent from the following detailed description of the presently preferred embodiments thereof, which description should be considered in conjunction with the accompanying drawings in which.

Figure 1:
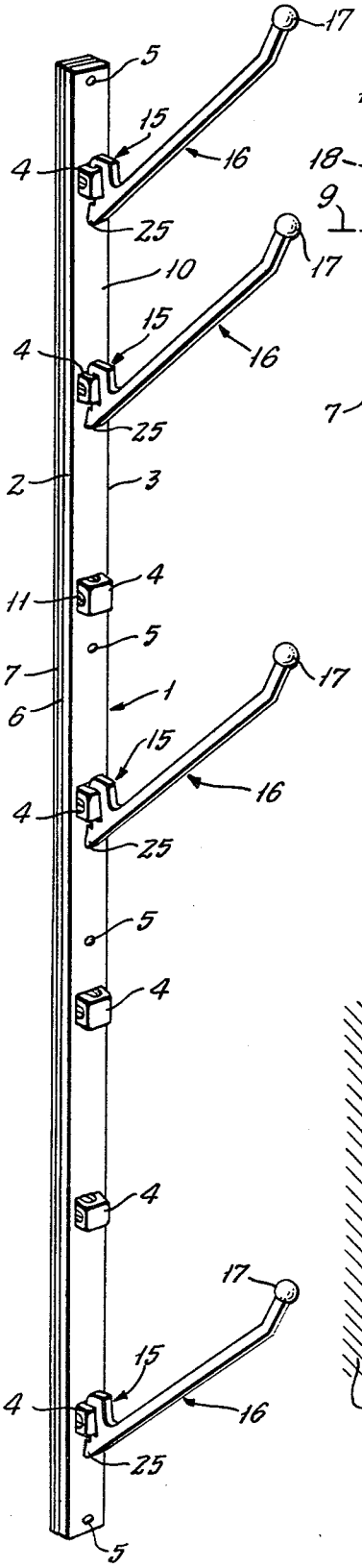
FIG. 1 is an isometric view of the preferred embodiment of the support member with a plurality of hooks thereon, the length of the support member extending vertically.

FIG. 1 illustrates the preferred embodiment of the invention which comprises a support member 1 which is relatively long and narrow and has a pair of lateral side edges 2 and 3. The support member 1 has a plurality of similar projections 4 integral therewith, and the support member 1 and the projections 4 may be molded from a plastics material, such as a medium impact polystyrene. However, other materials may be used.

The support member 1 may be secured to a support, such as a wall, display board, etc., by means of nails, screws or other fasteners extending through the holes 5, but preferably, the back surface of the member 1 has a layer 6 of a resilient material, such as sponge rubber, adhesively secured thereto. The surface of the layer 6 which faces away from the member 1 has an adhesive, such as a contact cement, thereon which remains active until a peelable, protective layer 7 is removed and the layer 6 is pressed against a support, such as the support 8 shown in FIG. 8. Thus, when the layer 7 is removed and the layer 6 is pressed against the support 8, the support member 1 remains in position and can be removed only by substantial forces directed so as to pull the member 1 away from the support 8.

Figure 4:
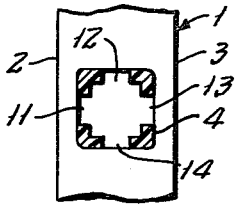
FIG. 4 is a fragmentary, front view of the support member with one of the multi-lateral projections in cross section.

Each of the projections 4 is hollow as indicated by the cross-section of one of the projections shown in FIG. 4. Preferably, each of the projections 4 is quadrilateral in cross section, but other cross-sectional shapes, e.g. circular, may be used. A portion of the outer surface of each projection 4 extends around a line, such as the line 9 (FIG. 2), which extends transversely, and preferably, perpendicularly, to the front face 10 of the member 1. The portions of such surface which are on opposite sides of the line 9 have hook receiving openings 11–14, the openings 11 and 13 being aligned and the openings 12 and 14 being aligned. Each of the openings 11–14 faces in a direction transverse to the line 9, and preferably, the oppositely facing openings 11 and 13 face in directions perpendicularly to the length of the member 1 and the oppositely facing openings 12 and 14 face in directions parallel to the length of the member 1 for purposes hereinafter described.

Each of the openings 11–14 is adapted to receive the free end 15*a* of an arm 15 (FIG. 2) of a relatively long and narrow hook 16 which has a free end 17 for receiving an article to be displayed. In the preferred embodiment, the invention, the arm 15 is J-shaped and has a shorter leg 18, and intermediate leg 19 and a longer leg 20, the leg 18 terminating in the free end 15*a*. An arm 21 also extends from the hook 16 in opposition to, or in alignment with, the free end 15*a* of the arm 15, and the arm 21 is receivable in the openings 11–14. Thus, when the arm 21 is in an opening 11–14 at one side of the line 9, the free end 15*a* of the arm 15 is in an opening 11–14 at the opposite side of the line 9. Preferably, the length of the leg 20 extends at an angle 22 (FIG. 2) of at least 45°, but not greater than 90°, to the length of the hook 16. An angle 22 of approximately 60° is most preferred and is illustrated in the drawings.

Figure 2:
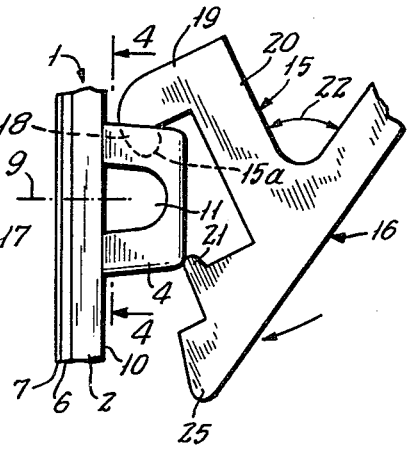
FIG. 2 is an enlarged, fragmentary, side elevation view illustrating the installation of a hook on the support member of FIG. 1.
Figure 3:
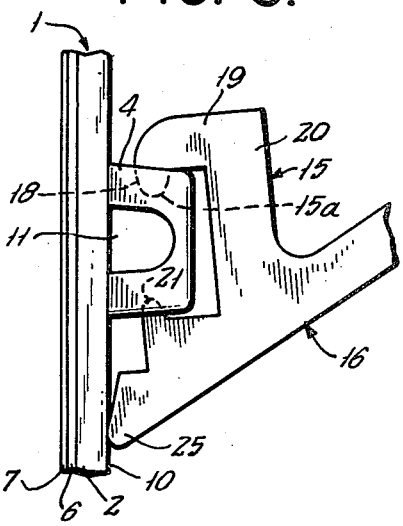
FIG. 3 is similar to FIG. 2 but shows the hook after installation.

Preferably, the spacing between the free end 15*a* of the arm 15 and the free end of the arm 21 is slightly less than the spacing between the outermost sides of the openings in which such free ends are received so that the free ends "snap into" the openings as illustrated by FIGS. 2 and 3. Thus, the spacing between the free ends of the arms 15 and 21 is slightly less than the spacing between the outermost sides of the openings 11 and 13 and the outermost sides of the openings 12 and 14. Preferably, also, the sides of the projections 4 taper toward each other in the direction away from the front face 10 so as to assist in the insertion of the free ends into the openings 11–14.

Figure 5:
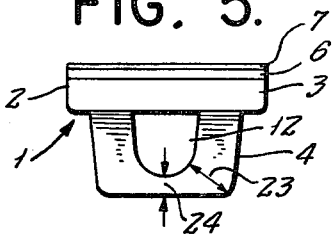
FIG. 5 is a plan view of a portion of the support member illustrated in the preceding Figure.
Figure 6:
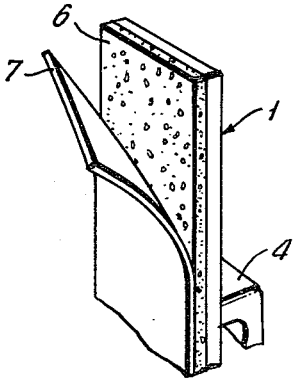
FIG. 6 is an isometric view of a portion of the support member as viewed from the rear.

Unless certain expedients are adopted, the hooks can rotate about an axis at the mid-point of the free end 15*a* and extending to the mid-point of the arm 21 after the hooks 16 are installed. Such rotation may not be desirable and may be restricted by shaping the leg 18 and the arm 21 so as to mate with the rectilinear side walls of the openings 11–14. Preferably, however, the rotation of the hooks 16 is limited to a small angle by selecting the spacings between the legs 18 and 20 and between the arm 21 and the leg 20 so that they are less than the distance between the periphery of an opening 11–14 and a portion of the surface of a projection 4 remote from the front face 10 so that the longer leg 20 will engage the projection 4 after limited rotation of the hook 16 around the axis of the free end 15*a*. Accordingly, with reference to FIG. 5, the distance 23 is greater than the spacing between the surface of the leg 18 nearest the leg 20 and the surface of the leg 20 nearest the leg 18. Similarly and preferably, the distance 23 is greater than the spacing between the surface of the arm 21 nearest the leg 20 and the surface of the leg 20 nearest the arm 21. Of course, if desired, the rotation of a hook 16 may be further limited by making the distance 24 (FIG. 5) between the periphery of an opening 11–14 and the face of the projection 4 most remote from the front face 10 substantially equal to the spacings between the surfaces of the leg 18 and the arm 21, on the one hand, and the leg 20, on the other hand.

Figure 7:
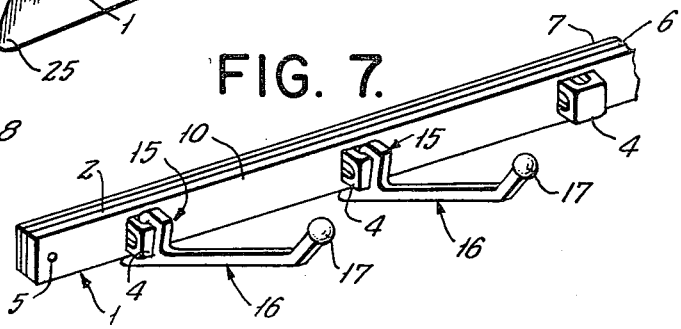
FIG. 7 is an isometric view of the support member with a plurality of hooks thereon, the length of the support member extending horizontally.

An embodiment of the invention as described hereinbefore and having adhesive means for securing the member 1 to a support is satisfactory when the member 1 has its length extending vertically as shown in FIG. 1 or horizontally as shown in FIG. 7 and when the articles to be displayed are relatively light in weight. Such embodiment is also satisfactory when the articles are heavier and the length of the member 1 extends vertically. However, it has been found that while the support member 1 will remain adhesively secured to a support with articles of a certain heavier weight on the hooks 16 and with the length of the member 1 extending vertically, the member 1 will pull away from a support with articles of such weight on the hooks 16 and when the length of the member 1 extends horizontally unless the hooks 16 are each provided with a foot 25 which is engagable with the support as illustrated in FIG. 8.

Figure 8:
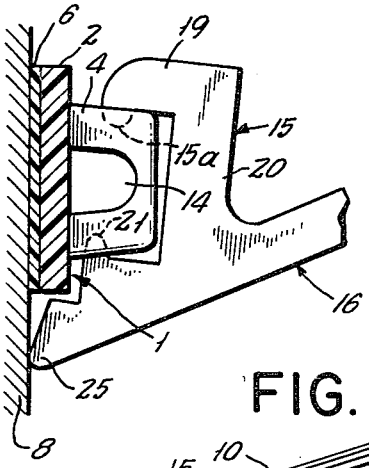
FIG. 8 is an enlarged, fragmentary end elevation view of a portion of the embodiment illustrated in FIG. 6.

As shown in FIGS. 2, 3 and 8, the foot 25 is farther from the free end 17 of the hook 16 than the arm 15. The foot 25 is also farther from the free end 17 than the arm 21. The spacing between the portion of the surface of the projection 4 which extends around an opening 11 or 14 which faces transversely to the length of the member 1, on the one hand, and the lateral side edge, 3 or 2 respectively, which is remote from such opening, on the other hand, is less than the distance between the inner surface of the intermediate leg 19 of the arm 15 and the foot 25 so that when the length of the member 1 extends horizontally, as shown in FIGS. 7 and 8, the foot 25 does not engage the member 1 and instead, engages the support 8. It has been found that such engagement of a foot 25 with a support 8 when the length of the member 1 extends horizontally permits the hooks 16 to carry heavier articles without detaching the member 1 from the support 8 than is the case when the foot 25 is not present.

It will be observed that the shape and size of the openings 11–14 are such that the hooks 16 are permitted to tilt in a plane perpendicular to the plane of the front face 10. Thus, the hooks 16 can tilt sufficiently to permit the feet 25 thereon to engage the support 8 when the length of the member 1 extends horizontally. When the length of the member 1 extends vertically, the openings 11–14 permit the hooks 16 to tilt upwardly an amount sufficient to permit the feet 25 to engage the front face 10 as shown in FIGS. 1 and 3.

Although the member 1 may have only a single projection 4, the preferred embodiment has a plurality of projections 4. In either case, the member 1 may be mounted with its length extending vertically or horizontally, and by suitably selecting the openings 11–14 into which the arms 15 and 21 are inserted, the hooks 16 may be properly oriented in either case. Accordingly, a single member 1 with a set of hooks 16 may be used for either a display rack with vertically aligned hooks or a display rack with horizontally aligned hooks.

While the arm 21 is desirable to assist in preventing displacement of the hooks 16 from the projections 4, the arm 21 may be omitted if desired. Similarly, if the articles to be displayed are only relatively light in weight, the foot 25 may be omitted. In the latter case, the base end of a hook 16 will abut the front face 10.

The support member 1 and the hooks 16 may be shipped and store unassembled, thereby reducing the space required, and the hooks 16 may be easily assembled with the member 1 by inserting a free end 15*a* of an arm 15 in an opening 11–14 and snapping the arm 21 into the opposite opening. The hooks 16 may be easily removed from the member 1 by the reverse of such procedure.

Although preferred embodiments of the present invention have been described and illustrated, it will be apparent to those skilled in the art that various modifications may be made without departing from the principles of the invention.

What is claimed is:

1. A display rack comprising a relatively long and narrow support member with a back face for for facing a support, a front face and lateral side edges, said support member having at least one projection extending from said front face, said projection having an outer surface extending around a line which extends transversely to said front face and having a first plurality of hook receiving openings in said surface which face in a direction transverse to said line and said openings being spaced apart in a direction peripherally of said line, said projection also having a second plurality of openings therein, each of said second plurality of openings being respectively on the opposite side of said line from one of said first plurality of openings, and a relatively long and narrow hook having a free end for receiving an article to be displayed and an opposite end for engaging said projection, said opposite end having an arm extending transversely to the length of said hook which is J-shaped and thereby has a longer leg joined to a shorter leg by an intermediate leg, said shorter leg having a free end and said free end of said shorter leg being detachably receivable in any one of said openings, whereby said support member may be mounted with the length thereof oriented in either of two directions transverse to each other and said arm of said free end of said shorter leg may be inserted into an opening selected to cause said arm to be substantially parallel to the length of said support member when the length of the latter is oriented in one of said two directions and into another opening selected to cause said arm to be substantially perpendicular to the length of said support member when the length of the latter is oriented in the other of said two directions, said hook also comprising a further arm extending therefrom in opposition to the shorter leg of said first-mentioned arm, whereby when the free end of said shorter leg of said first-mentioned arm is received in one of the first plurality of openings the further arm is received in the opposite one of said second plurality of openings.

2. A display rack as set forth in claim 1 wherein said first-mentioned arm extends at an acute angle to the length of said hook.

3. A display rack as set forth in claim 1 wherein one of said first plurality of openings and one of said second plurality of openings are aligned substantially in the direction of the length of said support member and wherein said opposite end of said hook has a foot farther from said free end of said hook than said first-mentioned arm and said further arm whereby said foot engages said front face when said first-mentioned arm and said further arm are in the aligned openings.

4. A display rack as set forth in claim 3 wherein one of said first plurality of openings faces transversely to the length of said support member and is adjacent one of said lateral side edges and wherein the spacing between the intermediate leg of said first-mentioned arm and said foot is greater than the spacing between the surface portion around said last-mentioned one opening and the other of said lateral side edges of said support member, whereby said foot is engageable with a support on which said support member is mounted when said free end of said shorter leg of said first-mentioned arm is received in said last-mentioned one opening.

5. A display rack as set forth in claim 4 wherein the distance between the longer leg of said first-mentioned arm and both said free end of the shorter leg of said first-mentioned arm and said further arm is less than the distance between the periphery of an opening and a portion of the surface of said projection remote from said front face, whereby movement of said hook around the axis of the free end of said shorter leg of said first-mentioned arm is limited by engagement of said first-mentioned arm with the surface of said projection.

6. A display rack as set forth in claim 4 further comprising adhesive means on said back face of said support member for securing the latter to a support.

7. A display rack as set forth in claim 6 wherein said adhesive means comprises a layer of resilient material adhesively secured at one face thereof to said back face and having adhesive material on its opposite face with a peelable layer of protective material on said adhesive material.

8. A display rack comprising a relatively long and narrow support member with a back face for facing a support, a front face and lateral side edges, said support member having a plurality of projections extending from its front face, said projections being spaced longitudinally of said member and each having an outer surface which extends around a line perpendicular to said front face, each said surface having at least four hook receiving openings therein, a first pair of said openings facing opposite to each other and in a direction perpendicular to the length of said member and a second pair of said openings facing opposite to each other and in a direction parallel to the length of said member, a plurality of relatively long and narrow hooks, each of said hooks having a free end for receiving an article to be displayed and having an opposite end, said opposite end having a first arm extending transversely to the length of the hook and insertable in any one of said openings and having a second arm spaced from and opposed to said first arm so that when the first arm is inserted in an opening the second arm extends into the opening facing oppositely to the opening into which the first arm is inserted and adhesive means on the back face of said member for securing said member to a support.

9. A display rack as set forth in claim 8 wherein each said hook has a foot at its opposite end, said foot being spaced from said first arm by a distance sufficient to permit said foot to engage a support on which said member is mounted when said second arm is in an opening which faces in a direction perpendicular to the length of said member.

* * * * *